United States Patent [19]

Berret et al.

[11] Patent Number: 4,829,927

[45] Date of Patent: May 16, 1989

[54] DEVICE FOR TERMINATING A STAY

[75] Inventors: Jean Berret, Saint Laurent de la Pree Fouras; Francois Chalain, Saint Gilles Croix de Vie, both of France

[73] Assignee: Chantiers Beneteau, Saint Hilaire De Riez, France

[21] Appl. No.: 80,737

[22] Filed: Aug. 3, 1987

[30] Foreign Application Priority Data

Aug. 3, 1986 [FR] France ..... 86 11221

[51] Int. Cl.[4] ..... B63B 21/04

[52] U.S. Cl. ..... 114/90; 114/218

[58] Field of Search ..... 114/39.1, 89–109, 114/111–115, 343, 364, 218

[56] References Cited

U.S. PATENT DOCUMENTS

| | | | |
|---|---|---|---|
| 4,200,944 | 5/1980 | Gillespie et al. | 114/218 |
| 4,313,391 | 2/1982 | Hall | 114/90 |
| 4,407,212 | 10/1983 | Anderson | 114/108 |
| 4,412,499 | 11/1983 | Hall | 114/108 |

FOREIGN PATENT DOCUMENTS

| | | | |
|---|---|---|---|
| 46007 | 2/1936 | France | 114/102 |
| 1050918 | 1/1965 | United Kingdom . | |

*Primary Examiner*—Sherman D. Basinger
*Assistant Examiner*—Stephen P. Avila
*Attorney, Agent, or Firm*—Browdy and Neimark

[57] ABSTRACT

A device for terminating a stay, such as one of the shrouds staying the mast of a sailboat, onto a structure, such as the hull of the sailboat, comprises a stay retaining member on which is an operative surface adapted to cooperate with a substantially complementary reaction surface. A chain plate comprises a housing adapted to accommodate the stay retaining member with a reaction surface substantially complementary to the operative surface on the stay retaining member and adapted to cooperate with it. An assembly for attaching the stay is fixed to the stay retaining member and arranged so that in use the stay exerts on the operative and reaction surfaces a force that is substantially transverse to them. Force is transferred from the chain plate to the structure by a tie. This has at one end a tie retaining member on which is an operative surface adapted to cooperate with a substantially complementary reaction surface. The chain plate also incorporates a housing adapted to accommodate this tie retaining member with a reaction surface substantially complementary to the operative surface on the tie retaining member and adapted to cooperate with it. The various cooperating operative and reaction surfaces are part-spherical. Each housing has a frustoconical hole in its bottom through which the respective stay or tie passes.

16 Claims, 2 Drawing Sheets

DEVICE FOR TERMINATING A STAY

BACKGROUND OF THE INVENTION

1. Field of the Invention

The present invention is generally concerned with a device for terminating a stay onto a structure, the device comprising a so-called "chain plate" adapted to cooperate with stay retaining means and means for transferring force from the chain plate to the structure.

The present invention is more particularly directed to the application of a device of this kind to staying the mast of a sailboat.

2. Description of the Prior Art

In known devices the chain plate comprises a plate to be fixed to the deck of the boat onto which are mounted numerous apertured plates. The shroud retaining means comprise shackle and retaining bolt devices and the force transfer means comprise one or more ties attached to the chain plate at a first end and comprising at their other end a shackle which is bolted onto a framework fast with the hull of the boat.

The chain plate is placed on and screwed to the deck by means of a backing plate disposed under the deck, which is therefore gripped between this backing plate and the chain plate. The forces in the shrouds are transmitted to the chain plate by the shackles attaching the shrouds and these forces are then transmitted to the hull by the tie or ties.

This structure is generally satisfactory. However, it has various disadvantages in use that the present invention proposes to remedy.

First of all, the shrouds are attached to the chain plate by shackle and retaining bolt devices; these are relatively time-consuming to fit and are particularly unesthetic. A specific object of the present invention is to avoid attaching the shrouds to the chain plate by means of shackles and retaining bolts.

Also, the tie is welded to the chain plate at its first end. Apart from the fact that this is costly in terms of manufacturing time, it has been observed on various occasions that these welds can be somewhat weak. Rupture of the weld could have serious disadvantages in that the forces in the shrouds would no longer be taken by the tie and the shrouds concerned would only be retained by the bolts fixing the chain plate to the deck. The forces communicated to the shrouds by the rigging are such that the attachment of the chain plate to the deck by these bolts is insufficient, with the attendant risk that the assembly could break, leading to loss of the mast.

Another disadvantage results from the fact that as the tie is welded to the chain plate the angle between the tie and the plate which supports the chain plate is fixed, which prevents any subsequent displacement unless a universal joint is incorporated into the assembly. The same applies to the plates to which the shroud shackles are fixed, their geometry being fixed so that if for one reason or another the planes in which the shackles are fitted are not oriented along the axes of the shrouds concerned it is necessary to incorporate a device equivalent to a universal joint.

To avoid this, boatbuilders are obliged to provide as many chain plates as boats, which is hardly advantageous from the cost point of view.

Attention has therefore been directed to designing a device enabling displacement of the ties or shrouds relative to the chain plate so that it can be used on various type boats.

SUMMARY OF THE INVENTION

In one aspect, the present invention consists in a device for terminating a stay onto a structure, comprising a stay retaining member, an operative surface on said stay retaining member adapted to cooperate with a substantially complementary reaction surface, a chain plate, a housing in said chain plate adapted to accommodate said stay retaining member, a reaction surface on said housing substantially complementary to said operative surface on said stay retaining member and adapted to cooperate therewith, stay attachment means fixed to said stay retaining member and arranged so that in use said stay exerts on said operative and reaction surfaces a force that is substantially transverse to said surfaces, and means for transferring force from said chain plate to said structure.

In a preferred embodiment of the invention, said means for transferring force from said chain plate to said structure comprise a tie, a tie retaining member fitted to one end of said tie, an operative surface on said tie retaining member adapted to cooperate with a substantially complementary reaction surface, a housing on said chain plate adapted to accommodate said tie retaining member and a reaction surface on said housing substantially complementary to said operative surface and adapted to cooperate therewith.

In another aspect, the invention consists in the application of this device to staying the mast of a sailboat.

This operative surfaces are advantageously part-spherical.

By virtue of these arrangements, and in particular by virtue of the cooperation between the complementary operative and reaction surfaces, the forces in the stays are transmitted to the tie.

The part-spherical character of the operative surfaces advantageously makes it possible to orient the stay or stays and the tie or ties in different directions.

It will also be noted that the device is of great simplicity, comprising a minimal number of parts, and that the shackle and retaining bolt devices have been dispensed with.

The characteristics and advantages of the invention will emerge from the following description given with reference to the appended drawings.

DESCRIPTION OF THE PREFERRED EMBODIMENT

Figure 1:
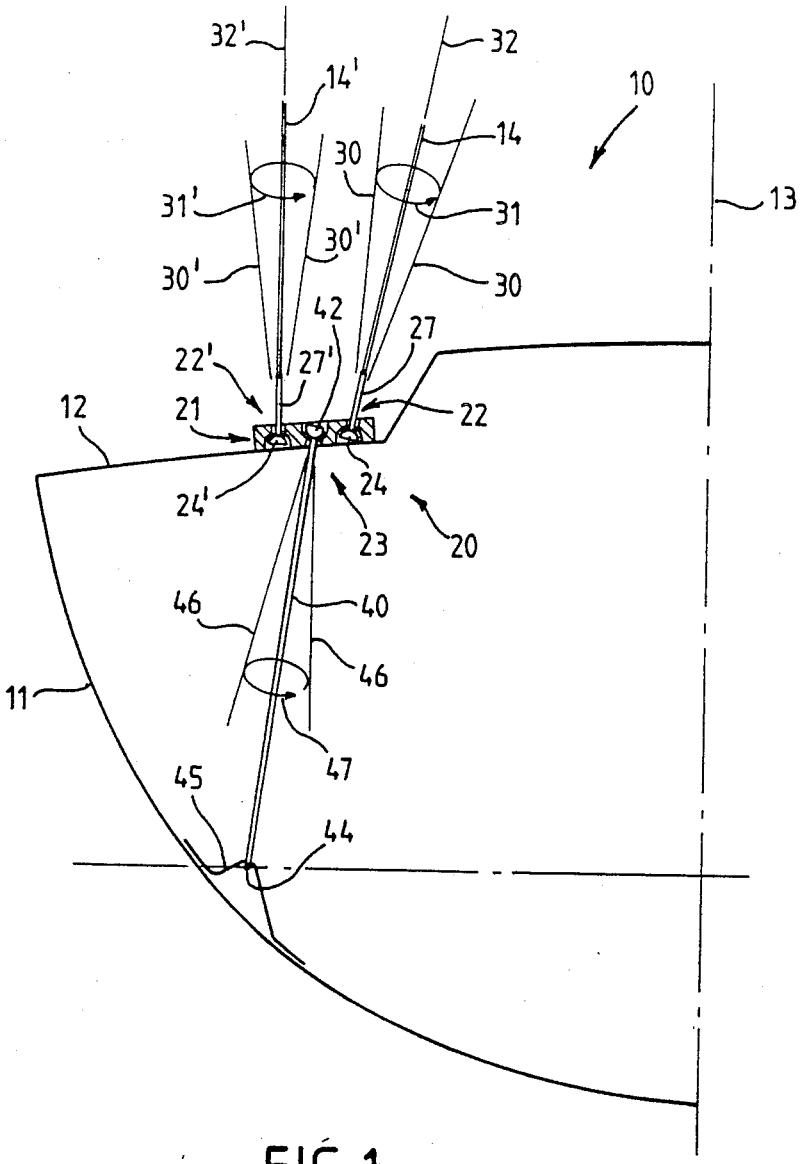
FIG. 1 is a schematic half-view in transverse cross-section of the hull of a sailboat equipped with a device in accordance with the invention.

A sailboat 10 comprises a hull 11, a deck 12, and a mast having a main axis 13.

The mast is stayed by means of shrouds, two of which (14, 14') are shown.

A device 20 is provided for transferring forces from the shrouds 14, 14' to the hull 11.

The device 20 comprises a so-called chain plate 21, shroud retaining means 22, 22' and means 23 for transferring force from the chain plate to the hull.

The retaining means 22, 22' for the shrouds 14, 14' comprise a shroud retaining member 24, 24' which has a so-called "operative" surface 25, 25'. This is advantageously part-spherical. The retaining means also comprise means for attaching the shrouds 14, 14', consisting in a tube 27, 27' gripping the shroud 14, 14' and applying to it a friction force greater than the tension in the shroud.

The chain plate 22 comprises two housings 28, 28' for the shroud retaining members. These housings have a rection surface 26, 26' (FIG. 2) that is substantially complementary to the operative surface 25, 24' on the retaining members 24, 24' for the shrouds 14, 14'.

The reaction surface 26, 26' is part-spherical, having the same radius of curvature as the surface 25, 25' of the retaining member 24, 24'.

In other embodiments (not shown) also utilizing a part-spherical operative surface, it is possible to provide a reaction surface 26, 26' having some other shape, such as a polyhedron, for example. However, it is preferable for this reaction surface to be substantially complementary to the operative surface so that the retaining member 25, 25' can assume various orientations, as will be explained hereinafter.

If the shroud retaining member has a shape other than part-spherical, such as a polyhedral shape, for example, the reaction surface will have to have at least in part a complementary polyhedral shape so as to lock the shroud retaining member in at least one predetermined position.

The attachment means in the form of the tubes 27, 27' are arranged in such a way that in use, as shown in the figures, the shrouds 14, 14' exert on the operative surfaces 25, 25' and the reaction surfaces 26, 26' a force that is in a direction substantially transverse to the operative and reaction surfaces. In the embodiment shown here the tubes 27, 27' gripping the shrouds 14, 14' are radially disposed on the retaining members 24, 24'.

A hole 29, 29' is provided in the housing 28, 28' for the tube 27, 27' to pass through. This hole 29, 29' is of frustoconical shape, the apex of the cone being at the center of the part-spherical surfaces 25, 25', 26, 26'.

Figure 2:
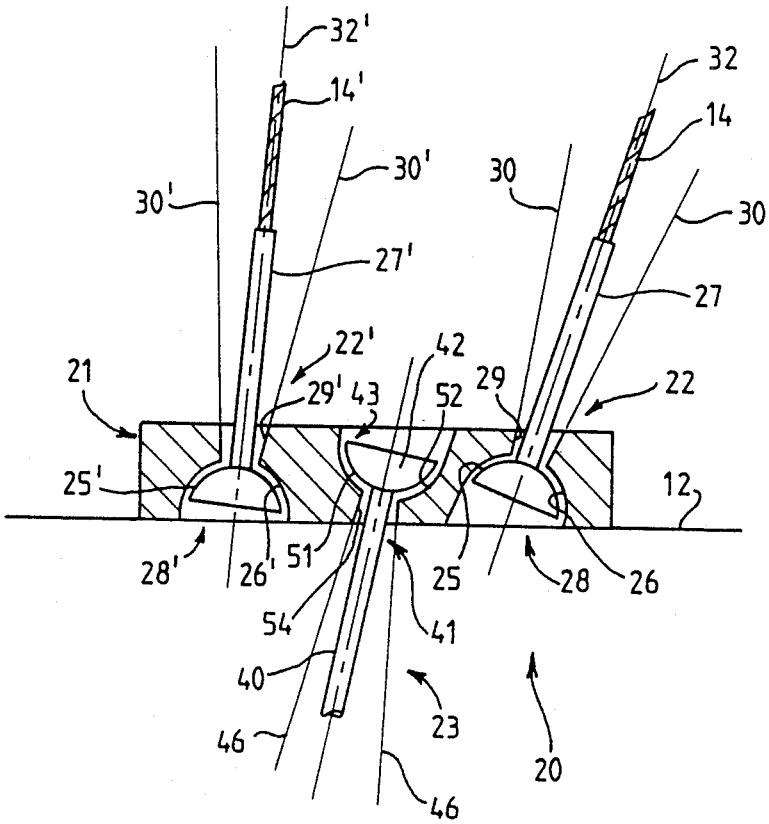
FIG. 2 is a view to a larger scale of the device shown in FIG. 1.

FIG. 2 shows that the frustonconical hole 29, 29' defines a relatively wide solid angle schematically represented by the lines 30, 30' and the arrows 31, 31' in FIG. 1. Thus the attachment tubes 27, 27' and the associated shrouds 14, 14' can take up various orientations in space relative to the axis of symmetry 32, 32' of each of the frustoconical holes 29, 29', as schematically represented in the figures.

In the embodiment shown in FIG. 1, the force transfer means 23 comprise a tie 40 which has at one end 41 a tie retaining member 42 having a part-spherical operative surface 51 similar to the part-spherical surface 25. The chain plate comprises a housing 43 for the tie retaining member having a reaction surface 52 substantially complementary to the operative surface of the tie retaining member. The housing 43 is similar to the housing 28, 28' for the shroud retaining member; note, however, that the housings 28, 28' face towards the deck 12 whereas the housing 43 for the tie retaining member faces upwards.

At its other end the tie 40 has a ball-shape retaining member 44 mounted on a fixing bracket 45 attached to the hull 11 in such a way that the tie 40 is locked in position between the chain plate 20 and the fixing bracket 45.

Note that the tie may also be oriented anywhere within a solid angle shown by the lines 46 and the arrow 47, a frustoconical hole 54 similar to the holes 29, 29' being provided in the bottom of the housing 43.

The shrouds 14, 14' and the tie 40 are provided in the conventional way with adjustment devices for altering the tension in them, these devices usually being called turn buckles. They have been omitted from the figures in order to simplify them.

In use the shrouds 14, 14' exert an upward tension force and the tie exerts a downward tension force. The orientation of the holes 29, 29' in the housings for the shroud retaining members and the hole 54 for the tie retaining member enable displacement of the shrouds 14, 14' and of the tie 40 within the solid angles 30, 30' and 46. This arrangement not only enables this displacement within these solid angles but also makes it possible to fit the device in accordance with the invention to different boats, which is particularly advantageous.

Note that the tie is oriented according to the resultant of the tension forces exerted by the shrouds 14, 14'. Thus in this embodiment the chain plate 20 does not need to be bolted onto the deck 12 of the sailboat, since no lateral force is exerted on the chain plate. If this were not so, because of the design of the sailboat, it would be possible without departing from the scope of the invention to provide means for fixing the chain plate to the deck of the sailboat as in the prior art.

A conventional silicone rubber seal is provided where the chain plate 20 contacts the deck 12. The hole 43 in the housing for the tie retaining member may be sealed by means of a plastics material plug (not shown).

It is to be understood that the present invention is not limited to the embodiment described and shown but encompasses all variants thereof within the competence of those skilled in the art.

In particular, note that instead of the frustoconical holes 29, 29' and 54 it is possible to provide cylindrical holes of greater diameter than the members 27, 40 so that these members can assume various orientations in space, as shown in the figures.

I claim:

1. Device for terminating a stay onto a structure, comprising at least one stay retaining member, an operative surface on said stay retaining member adapted to cooperate with a substantially complementary reaction surface, a chain plate, a housing in said chain plate adapted to accommodate said stay retaining member, a reaction surface on said housing substantially complementary to said operative surface on said stay retaining member and adapted to cooperate therewith, at least one stay attachment means fixed to said stay retaining member and arranged so that in use said stay exerts on said operative and reaction surfaces a force that is substantially transverse to said surfaces, and means for transferring substantially all forces from said chain plate to said structure.

2. Device according to claim 1, wherein said operative surface on said stay retaining member is part-spherical.

3. Device according to claim 1, wherein said reaction surface on said housing adapted to accommodate said stay retaining member is part-spherical.

4. Device according to claim 1, wherein said means for transferring force from said chain plate to said structure comprise a tie, a tie retaining member provided at one end of said tie, an operative surface on said tie retaining member adapted to cooperate with a substantially complementary reaction surface, a housing on said chain plate adapted to accommodate said tie retaining member and a reaction surface on said housing substantially complementary to said operative surface and adapted to cooperate therewith.

5. Device according to claim 4, wherein said operative surface on said tie retaining member is part-spherical.

6. Device according to claim 4, wherein said reaction surface on said housing adapted to accommodate said tie retaining member is part-spherical.

7. Device according to claim 1, wherein said housing adapted to accommodate said stay retaining member has a substantially frustoconical hole in its bottom.

8. Device according to claim 4, wherein said housing adapted to accommodate said tie retaining member has a substantially frustoconical hole in its bottom.

9. Device for staying the mast of a sailboat, comprising at least one shroud retaining member, an operative surface on said shroud retaining member adapted to cooperate with a substantially complementary reaction surface, a chain plate, a housing in said chain plate adapted to accommodate said shroud retaining member, a reaction surface on said housing substantially complementary to said operative surface on said shroud retaining member and adapted to cooperate therewith, at least one shroud attachment means fixed to said shroud retaining member and arranged so that in use said shroud exerts on said operative and reaction surfaces a force that is substantially transverse to said surfaces, and means for transferring substantially all forces from said chain plate to the hull of said sailboat.

10. Device according to claim 9, wherein said operative surface on said shroud retaining member is part-spherical.

11. Device according to claim 9, wherein said reaction surface on said housing adapted to accommodate said shroud retaining member is part-spherical.

12. Device according to claim 9, wherein said means for transferring force from said chain plate to the hull of said sailboat comprise a tie, a tie retaining member provided at one end of said tie, an operative surface on said tie retaining member adapted to cooperate with a substantially complementary reaction surface, a housing on said chain plate adapted to accommodate said tie retaining member and a reaction surface on said housing substantially complementary to said operative surface and adapted to cooperate therewith.

13. Device according to claim 12, wherein said operative surface on said tie retaining member is part-spherical.

14. Device according to claim 12, wherein said reaction surface on said housing adapted to accommodate said tie retaining member is part-spherical.

15. Device according to claim 9, wherein said housing adapted to accommodate said shroud retaining member has a substantially frustoconical hole in its bottom.

16. Device according to claim 12, wherein said housing adapted to accommodate said tie retaining member has a substantially frustoconical hole in its bottom.

* * * * *